US005749478A

United States Patent [19]

Ellis

[11] Patent Number: 5,749,478

[45] Date of Patent: May 12, 1998

[54] IN-LINE GRAVITY FEED SHELF SYSTEM

[75] Inventor: M. Jeffrey Ellis, Spring Valley, N.Y.

[73] Assignee: Burns Philp Food Inc., San Francisco, Calif.

[21] Appl. No.: 378,598

[22] Filed: Jan. 26, 1995

[51] Int. Cl.[6] ..... A47F 1/04

[52] U.S. Cl. ..... 211/59.2; 211/90; 211/187

[58] Field of Search ..... 211/59.2, 175, 211/90, 187; 108/107, 108, 109, 102, 143; 248/429, 424

[56] References Cited

U.S. PATENT DOCUMENTS

| | | | |
|---|---|---|---|
| 2,769,551 | 11/1956 | Just | 211/59.2 |
| 3,915,097 | 10/1975 | Young | 211/187 |
| 4,635,890 | 1/1987 | Matsuda | 248/429 |
| 4,771,898 | 9/1988 | Howard | 211/59.2 |
| 4,923,070 | 5/1990 | Jackle | 211/59.2 |
| 5,048,699 | 9/1991 | Trevaskis | 211/59.2 |
| 5,076,529 | 12/1991 | Dove | 248/429 |
| 5,115,920 | 5/1992 | Tipton | 211/187 |
| 5,197,610 | 3/1993 | Bustos | 211/59.2 |
| 5,425,522 | 6/1995 | Retzlaff | 248/429 |
| 5,577,623 | 11/1996 | Bustos | 211/59.2 |

FOREIGN PATENT DOCUMENTS

| | | | |
|---|---|---|---|
| 641743 | 5/1962 | Canada | 211/59.2 |

*Primary Examiner*—Ramon O. Ramirez
*Assistant Examiner*—Gwendolyn W. Baxter
*Attorney, Agent, or Firm*—Limbach & Limbach L.L.P.

[57] ABSTRACT

A display shelf is slidably coupled to a gondola by support members so that the tray may be moved between a display position and a stocking position.

6 Claims, 4 Drawing Sheets

IN-LINE GRAVITY FEED SHELF SYSTEM

BACKGROUND OF THE INVENTION

The invention described herein relates to the retail and wholesale display of food products and grocery items, particularly spices, or any similar product which is date sensitive.

Typically, grocery products are stored on rigid fixed shelves which are attached to a standard support structure, or gondola. In the stocking of goods and products which are date sensitive, e.g. dairy products, spices, etc., it is necessary to display and sell the oldest dated goods first. As a result, during the stocking process, the old product is manually moved to the front of the display rack or shelf, and the newest or most recently dated product is stored on the back of the shelf.

At the same time, it is desirable to maximize the quantity of product which can be displayed. Generally, retail distribution centers such as grocery stores have large quantities of product competing for limited retail display space. Consequently, standard display shelves and gondolas are constructed with the maximum number of shelves limited by the spacing required for the size of the product.

Due to the structure of standard gondolas and the placement of the shelves, there is limited space to move old product and insert new product, making the stocking process of date sensitive products slow and inefficient. Because of the limited space between shelves and product, it is difficult to place the new product in the back of the shelf while the older product remains on the shelf. Generally, a stocking person must manually move the older product to the front of the shelf, and then try to insert newer product in the narrow space between the product already on the shelf and the bottom of the above shelf. This results in an extremely cumbersome and slow stocking process.

In some cases, this problem is solved by rear loading gondolas, such as those used in refrigeration chambers which allow the stocking person to load new product from the rear. In the case of non-refrigerated goods, such as spices, which are typically displayed in aisles without rear access, this method of stocking is unavailable.

At the same time, it is necessary to provide a display shelf which maximizes display and storage space.

It is therefore an object of the present invention to provide a display shelf which increases display space, minimizes space between shelves, which also facilitates simple and efficient stocking of goods displayed on the shelves.

SUMMARY OF THE INVENTION

The present invention is a display shelf utilizable in a gondola for the display of time sensitive goods. The display shelf comprises a tray which is slidable to and from the gondola. In the display position, the tray is proximate to the gondola. In the stocking position, the tray is extended from the gondola such that time sensitive products may easily be placed on the rear of the tray and the oldest dated products are moved to the front of the tray. The tray is supported by a pair of support arms which are connected to a pair of brackets. The brackets are easily removable from the gondola.

Preferably, means are provided for locking and releasing the tray from a fixed position. A bell-crank is pivotally attached to the under side of the tray. A first rod is coupled to one end of the bell-crank and is accessible via a handle. A second rod is coupled to the other end of the bell-crank and is positioned to engage one or more stops. Biasing means are provided to bias the bell-crank so that the second rod engages a stop. By pulling the first rod, the bell-crank pivots and releases the second rod from the stop.

DETAILED DESCRIPTION OF THE INVENTION

Figure 1:
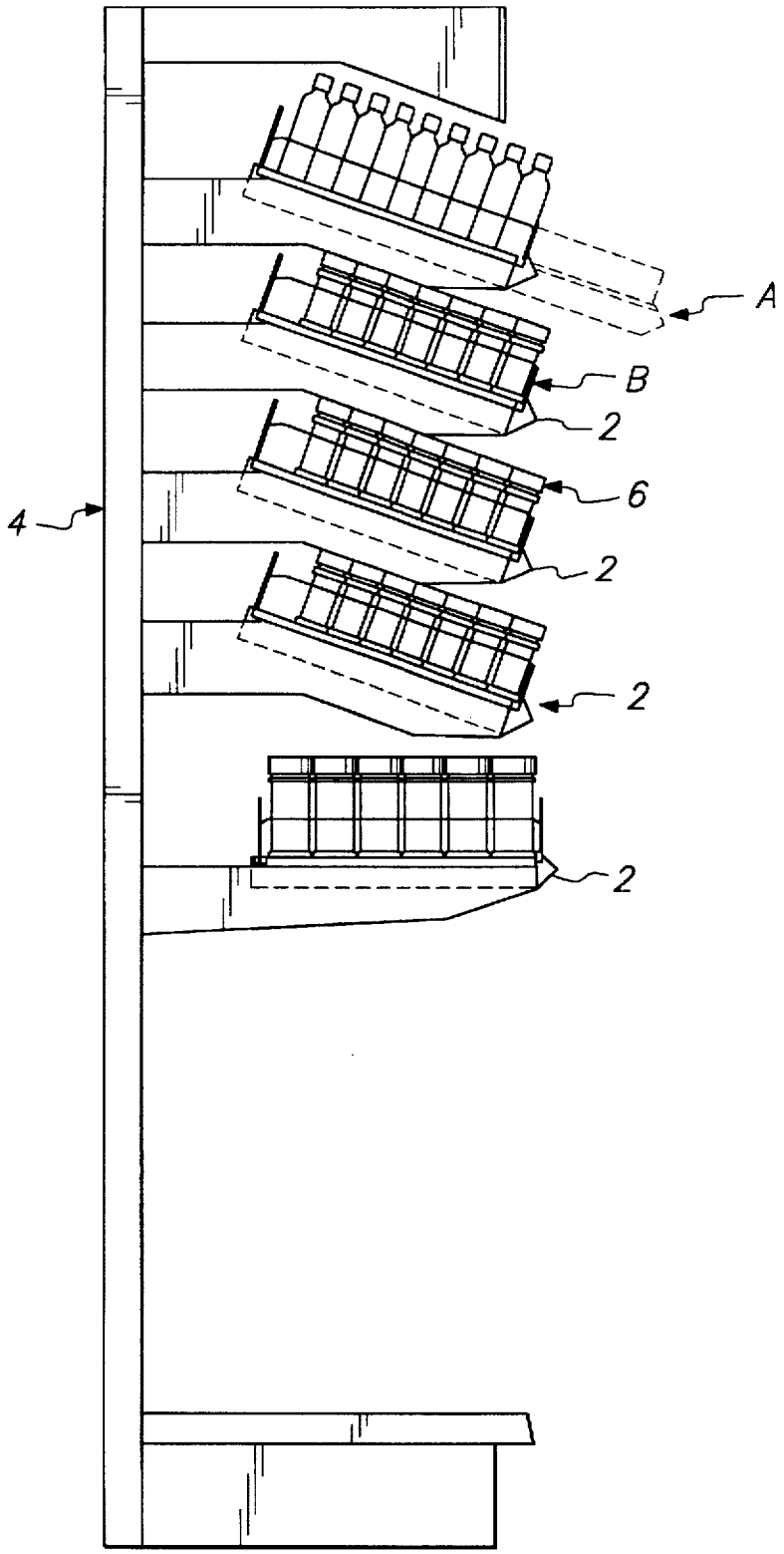
FIG. 1 is a side view showing the display shelf of the present invention utilized in a gondola.

As shown in FIG. 1, a plurality of display shelves 2 of the present invention are attached to a standard support structure or gondola 4. Preferably, the display shelves 2 are removable from the gondola 4. Advantageously, a variety of products 6 may be stocked on shelves 2. The display shelf 2 comprises a tray 8 (see FIG. 2) and means for supporting and slidably coupling the tray 8 to the gondola 4. The tray 8 may be extended from the gondola 4 to a stocking position "A" which is distal from the gondola 4 or retracted to a display position "B" which is proximate to the gondola 4.

Figure 2:
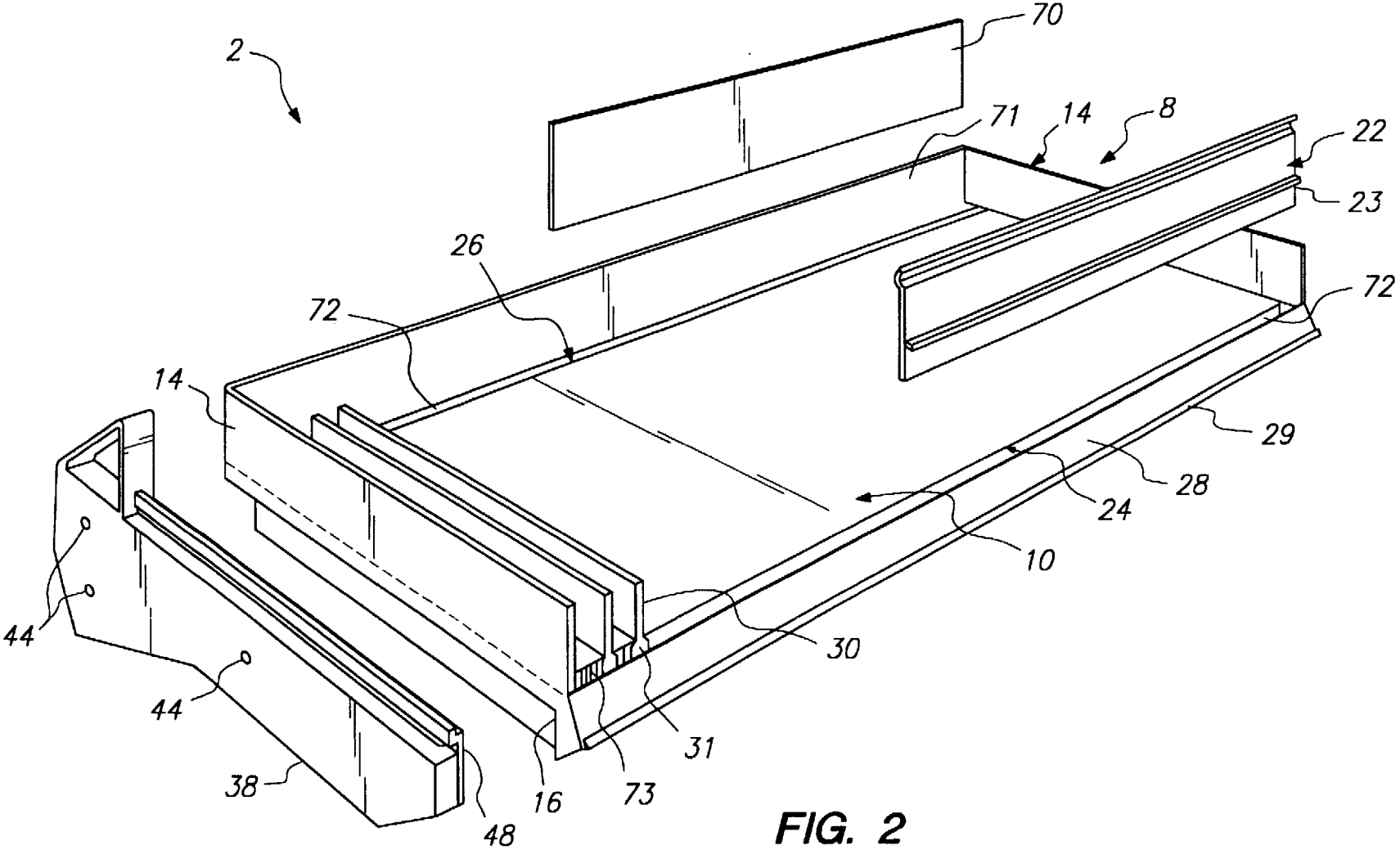
FIG. 2 is a top perspective view of the display shelf of the present invention.
Figure 3:
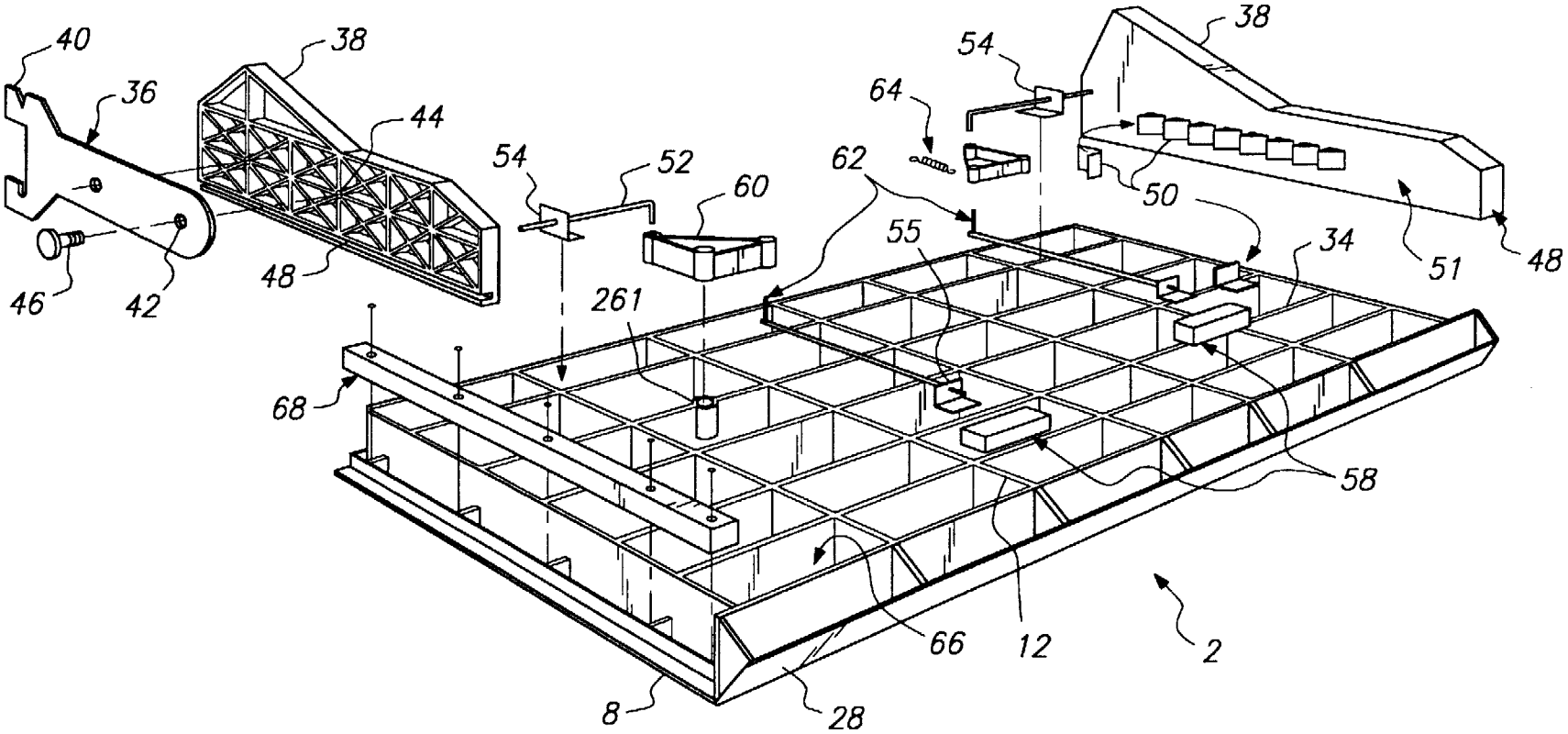
FIG. 3 is a bottom perspective view of the display shelf of the present invention.

Referring now to FIGS. 2 and 3, the display shelf 2 is rectangular in shape with an upper surface 10 and a lower surface 12, each surface having a front edge 24 and a rear edge 26. The tray 8 has two side walls 14 and a rear wall 71. The tray side walls 14 are formed with interlocking ribs 16 extending along the length of the side walls 14. In the preferred embodiment, the tray 8 is formed of plastic.

The tray 8 further includes a retaining lip 22 having a rib projection 23. The retaining lip 22 is connected to the front edge 24 of the upper tray surface 10. The retaining lip 22 may be connected by means of a snap-lock or other conventional connector commonly known in the art. The tray side walls 14 and rear wall 71 are integrally molded to the tray 8. A supplemental backwall 70, which is optional, may also be connected to the rear wall 71.

The tray 8 is further formed with a price channel 28 disposed proximate to the front edge 24 of the upper tray surface 10. The price channel 28 is defined by the integrally formed bevelled projection 29 and the rib projection 23 when the retaining lip 22 is coupled to the tray 8.

The upper tray surface 10 is preferably smooth and clean to facilitate the placement thereon of product 6. It is desirable to minimize protrusions or other objects on the upper tray surface 10 so as to maximize the space available for stocking product 6. A pair of channels 72 extend along the length of both front edge 24 and rear edge 26 of the upper tray surface 10. The channels 72 are formed with ridge projections 73 for engaging a plurality of dividers 30 disposed perpendicular to the front edge 24 on the upper tray surface 10. Preferably, the ridge projections 73 are formed at a 45° angle relative to the tray 8.

The dividers 30 are arranged so as to form rows in which product 6 may be stocked. The dividers 30 are plastic rectangular inserts having perpendicular tab projections 31 on each end thereof which are received in the respective channels 72. In this manner, the dividers 30 are removeably connected to the tray 8, but because of the friction created between the ridge projections 73 formed in the channel 72, the dividers 30 are firmly held in place. Alternatively, the dividers 30 may be wire separators or other commonly known devices used as a spacers in shelving arrangements. In the preferred embodiment, the tray 8 is 47.8" inches wide by 15.1" inches deep and has twenty-four dividers per tray, each spaced 1.5 inches apart from each other.

The lower tray surface 12, shown in FIG. 3 is integrally formed with a matrix of intersecting reinforcement ribs 34. The reinforcement ribs 34 define a plurality of cavities 66 on the lower tray surface 12.

The tray 8 is supported by a pair of brackets 36 coupled to a pair of support arms 38. The brackets 36 are formed of metal, plastic or other suitable material sufficient to support the tray 8 and the weight of the product 6 which may be loaded upon the tray 8. Each bracket 36 is formed with at least one and preferably two bracket projections 40, which engage receiving holes (not shown) in the gondola 4 so as to support the display shelf 2 from the gondola. Each support arm 38 is coupled to its corresponding bracket 36 via a connector 46, such as a screw, rivet, or bolt, which protrudes through a through-hole 42 formed in the bracket 36. Each support arm 38 has a plurality of through-holes 44 through which the connectors 46 may be inserted to couple the support arm 38 to the bracket 36. The horizontal angle of the support arm 38 relative to the bracket 36 and the gondola 4 may be changed by using alternate through-holes 44.

Figure 4:
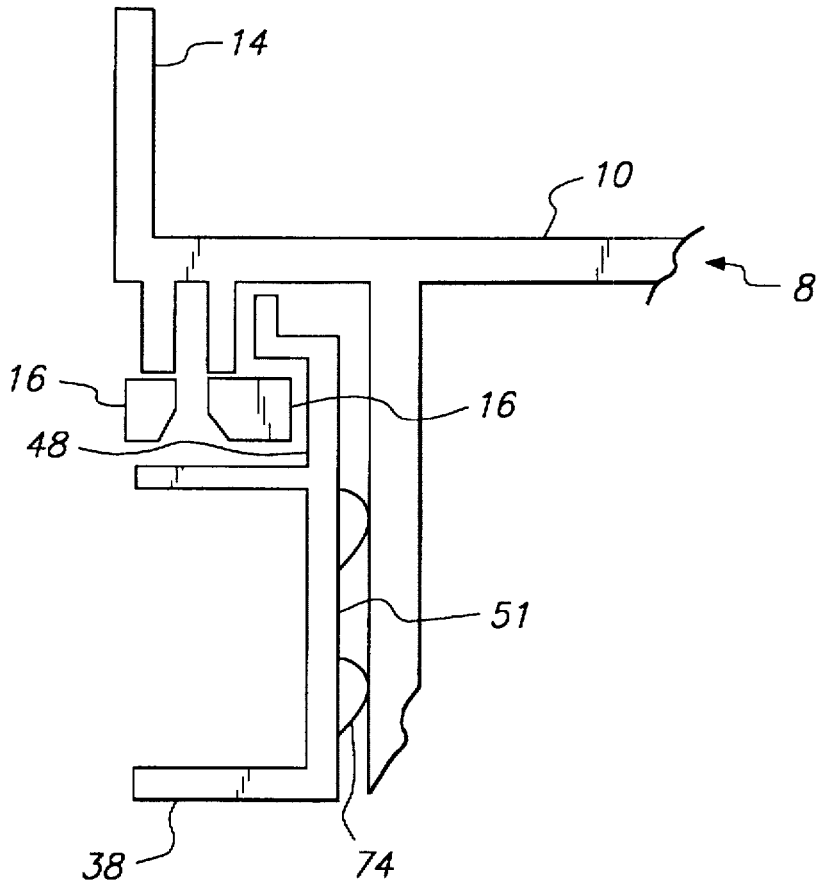
FIG. 4 is a cross-sectional view of the connection between the tray and the support arm.

Referring now to FIG. 4, the support arm 38 is formed with a slide channel 48 along the length of the support arm 38. The slide channel 48 cooperates with the tray 8 by receiving the corresponding interlocking rib 16 formed by the mounting block 68. Sliding movement is also facilitated by guide projections 74 formed on the support arm interior surface 51 which contact the tray 8. Through the coupling of the slide channels 48 and the interlocking ribs 16 beneath each side wall 14, the tray 8 may be moved from a display position "B" to a stocking position "A," as shown in FIG. 1. In the stocking position "A," the tray 8 is extended from the gondola 4, such that a space is created to facilitate stocking of new product 6.

Means are provided for locking the tray 8 in the display position "B" or the stocking position "A." A plurality of stops 50 are formed on an interior surface 51 of the support arm 38. The stops 50 may be formed as triangular or curved projections which extend from the interior surface 51 of the support arm 38. The stops 50 may be formed of metal or other suitable material such as plastic or rubber. In an alternative embodiment, the stops 50 could also be formed as a plurality of recesses, through-holes, or indentations on the interior surface 51 of the support arm 38.

Locking levers 52 are transversely mounted to the lower tray surface 12 and extend through through-holes 56 in guides 54. In the locking position, the locking lever 52 extends transversely across the lower tray surface 12 and engages the stop 50 at a predetermined position. This holds the tray 8 in a fixed position relative to the gondola 4 and the support arm 38. The locking levers 52 are constructed of metal.

Means are also provided to release the tray 8 from the display position or the stocking position. A pair of release handles 58 are positioned on the lower tray surface 12. Each release handle 58 is coupled to a bell crank 60 by a metal pull rod 62. The rod 62 is inserted through a guide 55 which is mounted on the lower surface 12. The bell crank 60 is mounted on a pivot 261 on the lower surface 12. Each bell crank 60 is coupled to a respective locking lever 52. When the release handles 58 are pulled, the bell cranks 60 rotate on pivot 261 (clockwise in this bottom view), thereby disengaging the locking levers 52 from the stops 50 formed in the support arms 38. This action releases the tray 8 from its fixed position within the support means thereby allowing the tray 8 to be extended or retracted as necessary to facilitate stocking or display.

Each release handle 58 is biased to a closed position by a spring 64, formed of metal, coupled to the bell crank 60 at one end and connected to the tray 8 at the other end. The springs 8 bias the release handles 58 such that when the release handles are not engaged, the locking levers 52 remains engaged with the stops 50 in the support arms 38. Other biasing means such as non-metallic elastic or plastic materials may also be used.

Alternatively, electromechanical motor driven mechanisms may be used to facilitate the sliding of the tray 8 from the display position to the stocking position according to techniques well known by those skilled in the art. Similarly, pulley, crank, gear, bearing, or wheel and rail systems may also be used in place of the interlocking ribs 16 and channels 48 to lock and release the tray 8 for sliding movement between display and stocking positions.

The specific embodiments herein shown and described should be considered as illustrative only. Various changes in structure will occur to those skilled in the art and these changes are to be understood as forming a part of this invention insofar as they fall within the spirit and scope of the appended claims.

What is claimed is:

1. A display shelf, comprising:

a tray having a lip for retaining product therebehind;

means for supporting the tray;

means for sliding the tray in a generally horizontal manner;

means for locking the tray in at least three predetermined horizontal positions, wherein the locking means comprises a plurality of stops positioned across the sliding means and at least one locking lever, wherein the lever is operable to engage a selected one of the stops to hold the tray in a fixed position; and means for releasing the locking means.

2. A display shelf according to claim 1, wherein the releasing means comprises at least one release handle coupled to a bell-crank, said bell-crank being pivotally attached to the tray and operable by the release handle to disengage the locking lever from the selected stop.

3. A display shelf according to claim 2, further comprising means for biasing the release handle in a locked position such that the locking lever engages the selected stop.

4. A display shelf mounted to a gondola, comprising:

a pair of support brackets removably coupled to the gondola;

a pair of support arms each having a tray groove and at least three stops positioned in a horizontal manner near the tray groove, each support arm being coupled to the respective support bracket;

a tray slidably coupled between the support arms and having a front lip and side walls, each side wall having a rib for mating with a respective tray groove;

at least one bell-crank pivotally disposed on one side of the tray;

at least one release handle mounted on the one side of the tray and coupled to the bell-crank; and at least one locking lever coupled to the bell-crank and positioned to operably engage the stops.

5. A display shelf according to claim 4, wherein the support means include means for adjusting a relative angle between the tray and the gondola.

6. A display shelf mounted to a gondola, comprising:

a tray having a front lip for retaining product there behind;

means for sliding the tray in a generally horizontal manner to and from the gondola, wherein the sliding means comprises means for supporting the tray and means for adjusting an angle between the tray and the gondola;

means for locking the tray in at least three predetermined horizontal positions alone the sliding means; and means for releasing the locking means.

* * * * *